United States Patent [19]

Bullis et al.

[11] Patent Number: 5,065,662

[45] Date of Patent: Nov. 19, 1991

[54] FIRING MECHANISM FOR REVOLVING BATTERY GUN

[75] Inventors: Stephen J. Bullis, Colchester; Steven R. Duke, Williston; Thomas W. Cozzy, Burlington; Glenn E. Rossier, Vergennes, all of Vt.

[73] Assignee: General Electric Company, Burlington, Vt.

[21] Appl. No.: 633,723

[22] Filed: Dec. 24, 1990

[51] Int. Cl.[5] ..... F41F 1/10

[52] U.S. Cl. ..... 89/12; 89/25.05

[58] Field of Search ..... 89/12, 13.05, 13.1, 89/11, 9, 27.12, 27.11, 127, 132, 27.3, 28.1, 28.05

[56] References Cited

U.S. PATENT DOCUMENTS

| | | | |
|---|---|---|---|
| 2,380,262 | 7/1945 | Quinnell et al. | 89/135 |
| 2,762,267 | 9/1956 | Persson et al. | 89/135 |
| 2,948,192 | 8/1960 | Evans et al. | 89/28.05 |
| 3,241,445 | 3/1966 | Zehfeld et al. | 89/28.05 |
| 3,703,845 | 11/1972 | Griew | 89/134 |
| 4,274,325 | 6/1981 | Snyder et al. | 89/12 |
| 4,345,505 | 8/1982 | Patenaude et al. | 89/12 |
| 4,359,927 | 11/1982 | Tassie | 89/12 |
| 4,359,928 | 11/1982 | Sawyer | 89/12 |
| 4,494,439 | 1/1985 | Sawyer | 89/12 |
| 4,550,641 | 11/1985 | Bruderer et al. | 89/12 |

FOREIGN PATENT DOCUMENTS

| | | | |
|---|---|---|---|
| 534689 | 3/1922 | France | 89/11 |
| 573920 | 3/1958 | Italy | 89/13.05 |

*Primary Examiner*—Deborah L. Kyle
*Assistant Examiner*—Stephen Johnson
*Attorney, Agent, or Firm*—Bailin L. Kuch; Robert A. Cahill

[57] ABSTRACT

In a firing mechanism for Gatling-type guns, separate safing and firing cams are located at a firing position coinciding with a notch in an annular safing ring against which cocking levers ride to maintain their firing pins in pre-cocked conditions. To safe the firing mechanism, the safing cam is positioned to bridge the notch and maintain the firing pins pre-cocked as they revolve through the firing position. When the mechanism is armed, a cocking ramp surface of the firing cam is then positioned to cam the cocking levers rearwardly, cocking their firing pins. Immediately thereafter, the cocking levers drop off a firing cam sear corner into the notch now exposed by the safing cam to successively fire off ammunition rounds.

9 Claims, 3 Drawing Sheets

FIRING MECHANISM FOR REVOLVING BATTERY GUN

This invention was made with U.S. Government support under Contract F08635-84-C-0289 awarded by the U.S. Air Force. The U.S. Government has certain rights in this invention.

The present invention relates generallly to revolving or Gatling-type guns and specifically to firing mechanisms therefor.

BACKGROUND OF THE INVENTION

The well-known Gatling-type gun includes a housing in which is journalled a rotor mounting an annular array of gun barrels, e.g. five in number, and a bolt assembly for each gun barrel. Each bolt assembly includes a firing pin biased in a forward, firing direction by a mainspring. A cocking lever extends laterally from the firing pin. As the rotor is driven in rotation, the gun barrels and their respective bolt assemblies successively revolve through an angular firing position where a firing mechanism is stationed. Each bolt assembly is cammed forwardly to load an ammunition round into the breech of the associated gun barrel and to partially cock its firing pin, and then its cocking lever is cammed rearwardly just prior to arrival at the firing position to fully cock the firing pin against the force of a fully charged mainspring. As each bolt assembly achieves the firing position, its cocking lever is released, and the firing pin springs forwardly to impact the primer of an ammunition round, thereby firing off the round.

Since the firing of ammunition rounds in a Gatling-type gun is incident to rotation of the rotor, there is an inherent danger of accidentally firing off rounds as a result of inadvertent rotor rotation. There are also occasions when it is necessary to purposely rotate the rotor in order to clear the gun of live rounds. To prevent accidental firing of rounds during rotor rotation, the firing mechanisms are traditionally equipped with safing provisions to prevent unintended release of the cocking lever of a cocked firing pin. Examples of such safing provisions are disclosed in Tassie U.S. Pat. No. 4,359,927, Snyder et al. U.S. Pat. No. 4,274,325, and Sawyer U.S. Pat. Nos. 4,359,928 and 4,494,439. The disclosures of these commonly assigned patents as specifically incorporated herein by reference.

SUMMARY OF THE INVENTION

It is accordingly an object of the present invention to provide an improved firing mechanism for Gatling-type guns.

A further object is to provide a firing mechanism of the above-character, wherein the accidental firing of ammunition rounds is reliably precluded.

An additional object is to provide a firing mechanism of the above-character having an improved safing feature to prevent unintended gun firing.

Another object is to provide a firing mechanism of the above character, wherein the safing and arming features thereof are positively interlocked such as to avoid any ambiguity between the safed and armed mechanism conditions.

A still further object is to provide a firing mechanism of the above-character, wherein the firing pins are cocked only when the firing mechanism is armed and then only as each firing pin enters the final approach to the firing position.

Yet another object is to provide a firing mechanism of the above-character, wherein the safing and arming features are simple in construction, easy to implement, and reliable in operation.

Other objects of the invention will in part be obvious and in part appear hereinafter.

In accordance with the present invention, a firing mechanism for a Gatling-type battery gun is provided with separate safing and firing cams mounted by a mechanism housing for movements between respective safe and armed positions relative to an annular safing ring. The safing and firing cams are equipped with actuating cams jointly acted upon by a single cam driver carried by an actuating link which is articulated by an actuator to dispose the safing and firing cams in either their safe or armed positions.

An annular array of firing pins are mounted by the gun rotor with their cocking levers riding against the safing ring to maintain the spring-backed firing pins in pre-cocked conditions. In their safe positions, the firing cam is disposed in forwardly displaced relation to the safing ring, while the safing cam is disposed in bridging relation with a notch in the safing ring at the angular gun firing position. The cocking levers thus ride against the safing cam as they successively revolve through the gun firing position, thereby maintaining the pre-cocked conditions of their firing pins. In their armed positions, the safing cam is displaced forwardly to expose the safing ring notch, while the firing cam is displaced rearwardly to dispose a cocking ramp surface in position to divert the cocking levers from the safing ring and cam the firing pins rearwardly to fully cocked conditions just as they revolve into the firing position. The cocking levers ride off a terminating sear corner of the cocking ramp surface into the safing ring notch, permitting their firing pins to spring forward into firing impact with the ammunition rounds.

The invention accordingly comprises the features of construction, combination of elements and arrangement of parts, all as described hereinbelow, and the scope of the invention will be indicated in the claims.

BRIEF DESCRIPTION OF THE DRAWINGS

For a full understanding of the nature and objects of the present invention, reference may be had to the following Detailed Description taken in conjunction with the accompanying drawings, in which.

Corresponding reference numerals refer to like parts throughout the several views of the drawings.

DETAILED DESCRIPTION

Figure 1:
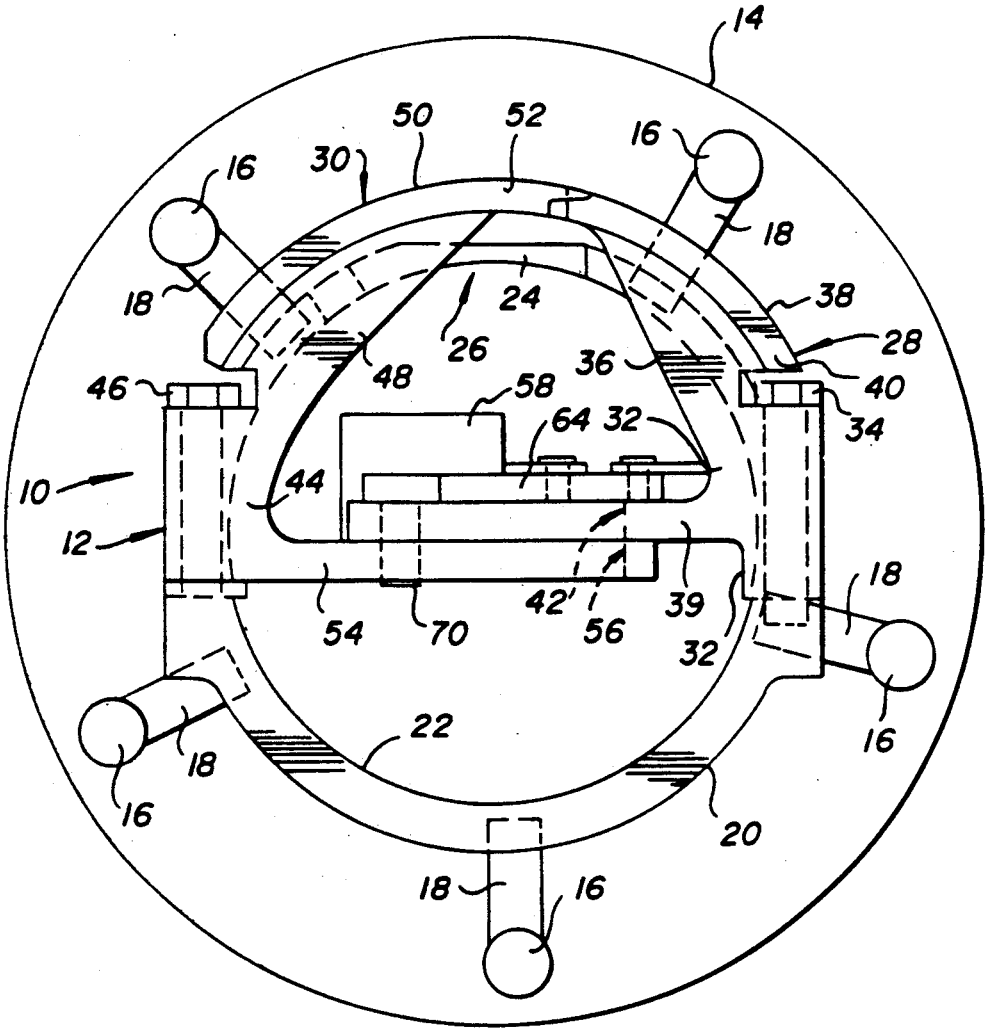
FIG. 1 is an end view of a firing mechanism for Gatling-type gun, constructed in accordance with the present invention.

The firing mechanism of the present invention, generally indicated at 10 in FIG. 1, includes a housing, generally indicated at 12, about which a rotor, generally indicated at 14, is concentrically mounted in the manner illustrated in FIG. 1 of the above-cited Tassie U.S. Pat. No. 4,359,927. The rotor carries an annular array of spring-backed firing pins 16 (five in the illustrated embodiment), one associated with each of the rotor-mounted gun barrels seen in the Tassie patent. Laterally inwardly extending from each firing pin is a cocking lever 18 which rides against an annular cam surface 20 of a safing ring 22 formed on the housing. This cam surface lies in a transverse plane through arc of approximately 300° and is interrupted through an approximate 60° arc by a relieved section or notch 24 (best seen in FIGS. 2 and 3), which is angularly located at a gun firing position, generally indicated at 26. As the rotor is rotated, the revolving cocking levers 18, while riding against the planar cam surface 20 of safing ring 22, maintain their firing pins in a safe, pre-cocked condition.

In accordance with the present invention, firing mechanism 10 is provided with a firing cam, generally indicated at 28, and a safing cam, generally indicated at 30, to deferentially act on cocking levers 18 as their firing pins 16 revolve through gun firing position 26, depending on whether the firing mechanism is in a safe condition or an armed condition.

Firing cam 28 is constructed having a hub 32 through which a bolt 34 extends to pivotally mount the firing cam to housing 12. Projecting angularly upwardly from hub 32 toward gun firing position 26 through a housing slot (not shown) located forwardly of safing ring 20 is an arm 36 which carries an arcuate firing cam element 38 formed with a rearwardly facing, cocking ramp surface 40, best seen in FIGS. 2 and 3. This cocking ramp surface is disposed radially beyond safing ring cam surface 20 and terminates at a sear corner 41 longitudinally aligned with notch 24. Projecting radially inwardly from hub 32 is an actuating arm 39 in which is formed a slot cam, generally indicated at 42, also best seen in FIGS. 2 and 3.

Figure 2:
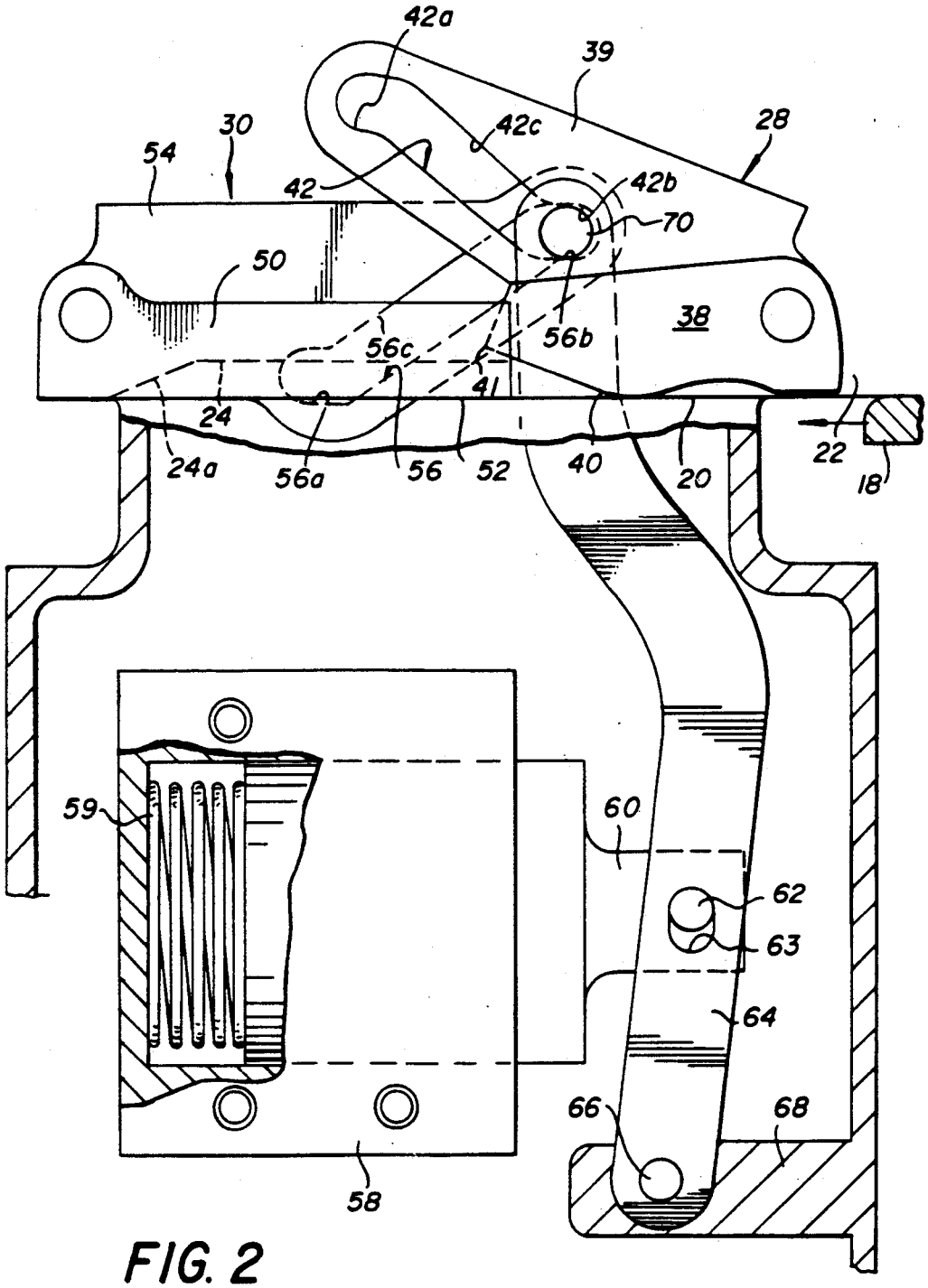
FIG. 2 is a top view of the firing mechanism of FIG. 1, shown in its safe condition.
Figure 3:
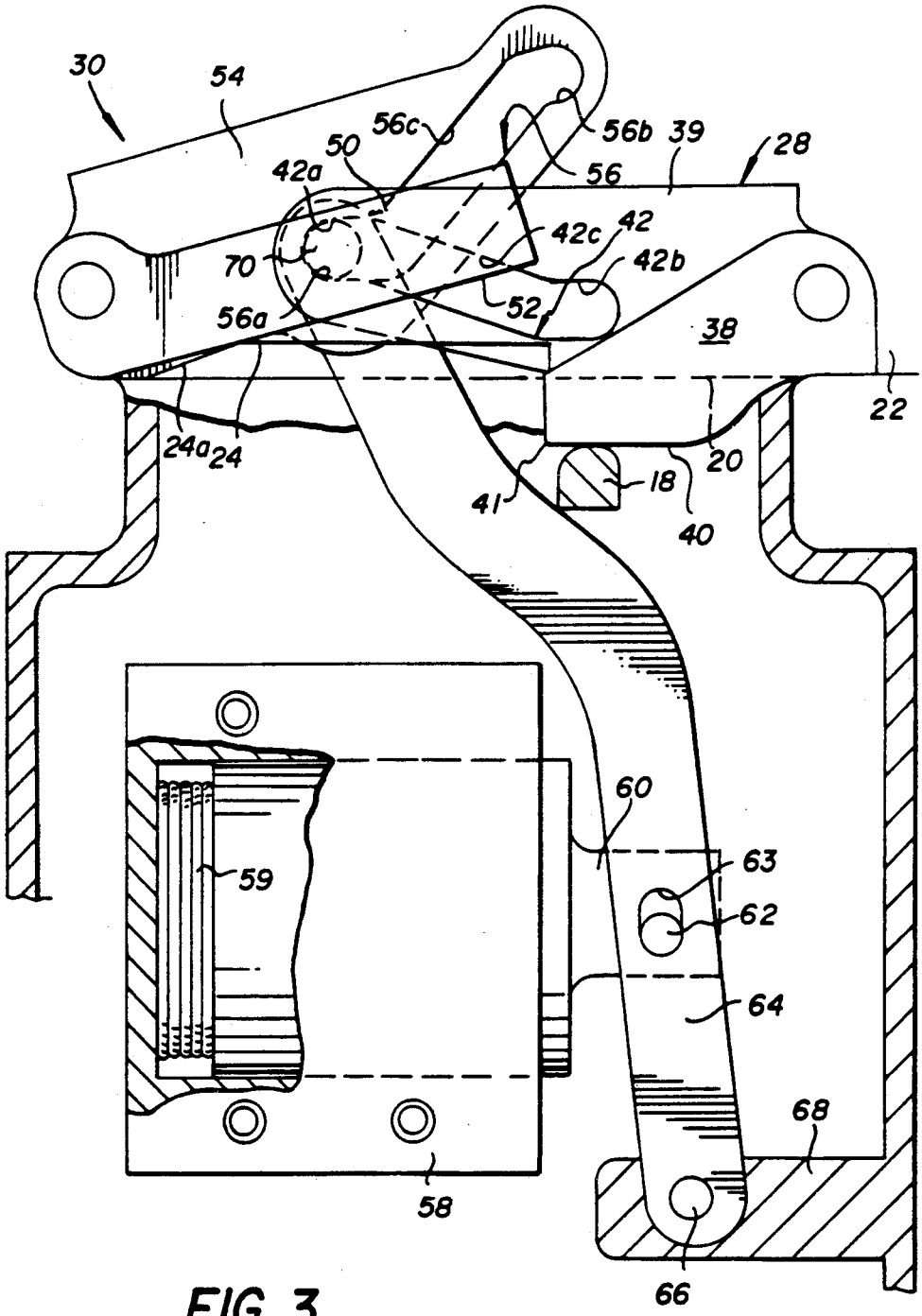
FIG. 3 is a top view of the firing mechanism of FIG. 1, shown in its armed condition.

Safing cam 30 is similarly constructed having a hub 44 through which a bolt 46 extends to pivotally mount the safing cam to the housing in essentially opposed relation to the firing cam. An arm 48 extends from the hub through a housing slot (not shown) and angularly upwardly toward firing position 26 where it carriers an arcuate safing cam element 50 formed with a rearwardly facing bridging cam surface 52. This cam surface is disposed radially beyond notch 24 in safing ring 20 and extends through an arc sufficient to span the notch, as well as to lap a portion of safing cam surface 22 immediately beyond the notch in the counter clockwise direction. An actuating arm 54 extends radially inwardly from hub 44 into lapping relation with actuating arm 39 of firing cam 28. As seen in FIGS. 2 and 3, a slot cam, generally indicated at 56, is formed in this actuating arm 54 in partial registry with slot cam 42.

Referring jointly to FIGS. 1–3, an actuator, in the form of a solenoid 58, is mounted within housing 12 with its plunger 60 carrying a pin 62 extending through an enlarged opening 63 in an actuating link 64. The lower end of this link, as seen in FIGS. 2 and 3, is pivotally mounted on a pin 66 carried by a clevis 68 provided within housing 12. The upper end of link 64 carries a stud 70 which extends laterally through slot cams 42 and 56 of firing cam 28 and safing cam 30, respectively. As seen in FIGS. 2 and 3, slot cam 42 is somewhat Z-shaped having short, transversely extending and longitudinally offset terminal portions **42*a* and 42*b* interconnected by an angularly extending actuating portion 42*c*. Actuating cam 56 is similarly Z-shaped having transversely extending and longitudinally offset terminal portions 56*a* and 56*b* interconnected by an actuating portion 56*c***.

While solenoid 58 is de-energized, a spring 59 biases plunger 60 to a rightmost quiescent position seen in FIG. 2. Link 64 in forced by plunger pin 62 to a safe position. Post 70 at the upper end of the link is disposed in terminal portion **42*b* of slot cam 42, positioning firing cam 28 in its clockwise-most safe position seen in FIG. 2. In this safe position, cocking ramp surface 40 is disposed forwardly of the portion of safing ring cam surface 20 immediately to the right of safing ring notch 24. At the same time, post 70 is disposed in terminal portion 56*b* of slot cam 56, positioning safing cam 30 in its clockwise-most safe position where bridging cam surface 52 is placed in coplanar relation with safing ring cam surface 20 and in spanning relation with notch 24. With rotor 14 rotating in the counterclockwise direction seen in FIG. 1 and thus the cocking levers 18 moving from right to left in FIG. 2, it is seen that the cocking levers ride against bridging cam surface 52 while revolving through firing position 26. The bridging cam surface thus serves as a continuum of the safing ring cam surface to maintain the firing pins 16** in their pre-cock (safe) conditions and thus incapable of firing off ammunition rounds.

To arm firing mechanism 10, solenoid 58 is electrically energized to its actuated state, pulling plunger 60 leftward. Link 64 is pivoted in the counterclockwise direction to its armed position seen in FIG. 3. Post 70, acting as a cam driver, is driven through the actuating portions **42*c* and 56*c* of slot cams 42 and 56, respectively, camming firing cam 28 and safing cam 30 in counterclockwise directions to their armed positions determined by arrival of the post in slot cam terminal portions 42*a* and 56*a*. With firing cam 28 in its armed position, cocking ramp surface 40 is disposed rearwardly of safing ring cam surface 20 to intercept the cocking levers 18 in their final approach to the firing position 26. The cocking levers are thus diverted from the safing ring cam surface by the cocking ramp surface and cammed rearwardly to fully cock their associated firing pins 16. It is seen that, with safing cam in its armed position, bridging cam surface 52 is moved forwardly to uncover notch 24. Thus, as the cocking levers ride off sear corner 41 at the terminus of cocking ramp surface 40, they are free to spring forward into notch 24 as their associated firing pins 16 are propelled into firing impact with ammunition round primers. As the discharged firing pins revolve through the firing position, their cocking levers are cammed back onto safing ring cam surface 20 by a ramped end portion 24*a* of notch 24**, thus restoring the firing pins to their pre-cocked conditions.

It is seen that, by utilizing a single cam driver (post 70) to actuate both the firing and safing cams, the two cams are positively intercoupled as they pivot between their respective armed and safe positions. Consequently, there can be no ambiguity in their movements and positionings. They are both either in their armed or their safe positions. If a cocking lever is riding on the cocking ramp surface near the sear corner when the firing mechanism is converted from its armed condition to its safe condition, it is seen that, as the firing cam swings forwardly, the safing cam swings rearwardly to pick up the cocking lever before its firing pin can impact the ammunition round primer. It will also be noted that, by virtue of the transverse orientations of the terminal portions of the slot cams, the safe and armed positions of the firing and safing cams are extremely stable in character. Also the loadings on these cams exerted by the cocking levers are taken up by the link pivot pin 66, rather the solenoid plunger.

The present invention has particular application to Gatling-type guns adapted to fire case telescoped ammunition rounds. As a consequence, bolt assemblies are not required. Instead, the firing pins are simply contained by longitudinally extending guides within the rotor and are not reciprocated fore and aft as they approach and leave the firing position incident to loading ammunition into the gun breeches. Thus, the firing pins are cocked solely by firing cam 28 immediately in advance of the firing position while the firing mechanism is in the armed condition. While the firing mechanism is in the safe condition, the firing pins are maintained pre-cocked by safing cam 30 with no increment of charge being applied to the mainsprings as the firing pins approach the firing position. Under these circumstances, the safe condition of firing mechanism 10 is inherently safer when adapted to case telescoped ammunition.

From the foregoing it is seen that the objects set forth above, including those made apparent from the Detailed Description, are efficiently attained, and, since certain changes may be made in construction set forth without departing from the scope of the invention, it is intended that matters of detail be taken as illustrative and not in a limiting sense.

Having described the invention, what is claimed as new and desired to secure by Letter Patent is:

1. A firing mechanism for a Gatling-type gun comprising in combination:

A. a housing;

B. a rotor rotatable with respect to said housing about a longitudinal axis;

C. a plurality of spring-biased firing pins mounted by said rotor in angularly spaced relation, each said firing pin including a cocking lever;

D. an annular safing ring carried by said housing and having an planar cam surface interrupted by a notch coinciding with an angular firing position of said rotor, said cocking levers bearing against said planar cam surface during rotation of said rotor to maintain said firing pins in pre-cocked conditions;

E. a firing cam mounted to said housing for movement between safe and armed positions, said firing cam having 1) a cocking ramp surface terminating at a sear corner longitudinally aligned with said safing ring notch, and 2) a first actuating cam;

F. a safing cam mounted to said housing for movement between safe and armed positions, said safing cam having 1) a bridging cam surface longitudinally aligned with said safing ring notch, and 2) a second actuating cam;

G. an actuator mounted by said housing, said actuator having quiescent and actuated states;

H. an actuating link mounted for movement by said actuator between safe and armed positions and carrying a cam driver in joint engagement with said first and second actuating cams;

I. with said actuator in said quiescent state, said link, said safing cam and said firing cam assume their respective safe positions with said bridging cam surface spanning said safing ring notch in substantial coplanar relation with said planar cam surface to maintain said cocking levers in said pre-cocked positions during movement past said notch and with said cocking ramp surface disposed in longitudinally displaced relation to said planar cam surface, and with said actuator in its actuated state, said link, said safing cam and said firing cam assume their respective armed positions with said bridging cam surface in longitudinally displaced relation to said safing ring notch and with said cocking ramp surface disposed to successively divert said cocking levers from said planar cam surface and fully cock said firing pins, said cocking levers successively dropping off said sear corner into said safing ring notch, thereby allowing said cocked firing pins to spring longitudinally forward to fire ammunition rounds.

2. The firing mechanism defined in claim 1, wherein said firing cam further includes a first arm carrying said first actuating cam, and said safing cam further includes a second arm carrying said second actuating cam, said first and second arms disposed in lapped relation to position said first and second actuating cams for joint engagement by said cam driver.

3. The firing mechanisms defined in claim 2, wherein said first and second actuating cams are in the form of first and second slot cams created in said first and second arms, respectively, said cam driver projecting through said first and second slot cams.

4. The firing mechanism defined in claim 3, wherein said actuating link is pivotally mounted adjacent one end to said housing and carries said cam driver adjacent the other end thereof, said link being driving connected to said actuator at a point intermediate said ends thereof.

5. The firing mechanism defined in claim 4, wherein said first and second slot cams are each Z-shaped in configuration having first and second longitudinally offset terminal portions interconnected by an actuating portion.

6. The firing mechanism defined in claim 5, wherein said cam driver is disposed in said first terminal portions of said first and second slot cams to sustain said firing and safing cams in their respective safe positions and is disposed in said second terminal portions of said first and second slot cams to sustain said firing and safing cams in their respective armed positions, pivotal movement of said link between its said safe and armed positions propels said cam driver through said actuating portions of said first and second slot cams to cam said firing and safing cams between their respective safe and armed positions.

7. The firing mechanism defined in claim 6, wherein said first and second terminal portions of said first and second slot cams are oriented transversely such that longitudinally directed forces exerted on said firing and safing cams by said cocking levers are absorbed by the pivotal mounting of said link to said housing.

8. The firing mechanism defined in claim 7, wherein said actuator is a solenoid having a plunger oriented in the transverse direction and pinned to said intermediate point of said link, said solenoid further including a spring for biasing said plunger to an extended position disposing said link in its said safe position while said solenoid is in said quiescent state, upon electrical activation of said solenoid to said actuated state, said plunger is retracted to dispose said link in its said armed position.

9. The firing mechanism defined in claim 8, wherein said bridging cam surface and said cocking ram surface are disposed radially beyond said safing ring.

* * * * *